US006295913B1

(12) United States Patent
Rothering

(10) Patent No.: US 6,295,913 B1
(45) **Date of Patent: *Oct. 2, 2001**

(54) AIR OPERATED HYDRAULIC TORQUE WRENCH PUMP

(75) Inventor: Lawrence P. Rothering, New Berlin, WI (US)

(73) Assignee: Applied Power Inc., Butler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/254,693

(22) PCT Filed: Sep. 16, 1997

(86) PCT No.: PCT/US97/16394

§ 371 Date: Mar. 15, 1999

§ 102(e) Date: Mar. 15, 1999

(87) PCT Pub. No.: WO98/12022

PCT Pub. Date: Mar. 26, 1998

Related U.S. Application Data

(63) Continuation-in-part of application No. 08/717,310, filed on Sep. 20, 1996, now Pat. No. 5,782,158.

(51) Int. Cl.[7] ..... F15B 21/02

(52) U.S. Cl. ..... 91/38; 91/4 R; 91/35; 60/394; 60/409; 173/2; 173/11; 417/12; 417/46

(58) Field of Search ..... 60/394, 409; 91/4 R, 91/35, 38; 173/2, 4, 11; 417/12, 27, 46

(56) References Cited

U.S. PATENT DOCUMENTS

| | | | |
|---|---|---|---|
| 3,084,674 | 4/1963 | Watson | 91/38 |
| 4,074,612 | 2/1978 | Miller | 91/290 |
| 5,567,886 | 10/1996 | Kettner | 73/862.23 |
| 5,782,158 * | 7/1998 | Rothering | 91/38 |

FOREIGN PATENT DOCUMENTS

| | | |
|---|---|---|
| 0502748 A | 9/1992 | (EP) . |
| 0625408 A | 11/1994 | (EP) . |

OTHER PUBLICATIONS

Applicant's Exhibit A, catalog page regarding "Pegasus™" Air Hydraulic Torque Wrench Pump, Pub.#9413–364 of Enerpac, A Unit of Applied Power Inc., Butler, WI, dated 4/94, admitted prior art.

* cited by examiner

*Primary Examiner*—F. Daniel Lopez
(74) *Attorney, Agent, or Firm*—Quarles & Brady LLP

(57) ABSTRACT

A hydraulic pump assembly (10) for powering a hydraulic torque wrench (24) is air-powered and has hydro-pneumatic control circuitry (39) which continues operation of an air motor (18) which drives the hydraulic pump (16) for a post-advance period after an advance actuator (55) is deactuated. Operation of the pump (16) is continued for a period sufficient to retract a double-acting torque wrench (24), to permit subsequent advances of the wrench (24) within the post-advance period without restarting the pump (16) or to permit a single acting wrench to be moved from one fastener to the next within the post-advance period without restarting the pump (16). Operation of the pump (16) is terminated when the post-advance period expires if the advance actuator (55) is not reactuated, so as to conserve energy and avoid unnecessary heating of the hydraulic fluid.

10 Claims, 3 Drawing Sheets

AIR OPERATED HYDRAULIC TORQUE WRENCH PUMP

This application is a continuation-in-part of U.S. patent application Ser. No. 08/717,310, filed on Sep. 20, 1996, and entitled "Air Operated Hydraulic Torque Wrench Pump" now U.S. Pat. No. 5,782,158.

BACKGROUND OF THE INVENTION

1. Field of the Invention

This invention relates to hydraulic pumps for providing hydraulic fluid under pressure to a hydraulic torque wrench, and in particular to such a pump which is air powered.

2. Discussion of the Prior Art

Air powered hydraulic torque wrench pumps for providing hydraulic fluid under pressure to operate a hydraulic torque wrench are known. Such a pump is connected to a source of compressed air, which is common in industry, and the compressed air drives an air motor of the pump which is mechanically coupled to drive a hydraulic pump. Operation of the hydraulic pump provides hydraulic fluid under pressure from a hydraulic fluid reservoir which is typically incorporated into the pump assembly. The air motor is typically a rotary air motor which is mechanically coupled to a rotary hydraulic pump, although linear air motors and hydraulic pumps are also possible.

In such pump assemblies, once the air motor is turned on, the pump typically continues to operate until the supply of air to the air motor is turned off by the operator. Since continuous operation of the hydraulic pump generates considerable heat in the hydraulic fluid which is being pumped, a heat exchanger has been provided as part of the pump assembly so as to provide cooling for the hydraulic fluid when the pump is operated for a long period of time. In these units, continuous operation of the pump was common, even though tightening of the fasteners using the hydraulic wrench was only intermittent. As a result, not only was the provision of the heat exchanger made necessary, but energy operating the pump during the periods that a fastener was not being tightened was wasted.

SUMMARY OF THE INVENTION

The invention provides a hydro-pneumatic control circuit for a compressed air-powered hydraulic torque wrench pump of the above-described type in which the controls continue operation of the air motor after the advance button is deactuated to drive the hydraulic pump until a post-advance period of operation has expired. If the pump assembly is used to provide power to a double acting wrench, the post-advance period provides power to retract the wrench, to make it ready for the next advance called for by the operator. If the next advance is called for by the operator (by actuating the advance actuator) during the-post-advance period, pump operation continues without interruption. When the advance actuator is once again deactuated, a new post-advance period of operation begins, at the end of which the pump will turn off unless the advance actuator is first reactuated, which will again continue operation without interruption as described above. This cycle of operation can continue so that the pump can be operated continuously if the advance actuator is reactuated before the end of the post-advance period. However, if the advance actuator is not reactuated before the end of the postadvance period, the air motor and pump will stop, thereby conserving energy and avoiding unnecessarily heating the hydraulic fluid.

In an especially useful form, the advance actuator actuates an air valve which when actuated pressurizes through a first air line a first pilot port of a first pressure actuated air valve, the actuation of which causes the air motor to come on. In this aspect, the first air line includes a flow restriction and a one-way check valve which bypasses the restriction in the flow direction toward the pilot port of the first pressure actuated valve. In the opposite flow direction, when the first pilot port is being relieved, the check valve blocks flow so it all must flow through the restriction, which acts as a timer to set the duration of the post-advance period of operation of the pump assembly.

In another preferred aspect, a second air line communicates air pressure from the first pressure actuated air valve to a pilot port of a second pressure actuated air valve. The second pressure actuated air valve shifts when the pilot port is actuated to admit pressurized air to an inlet of the air motor. This isolates the compressed air supply to the air motor so that the pressure supplied to the air motor is not affected by minor variations in the pressure drop past the first pressure actuated air valve.

In another useful aspect, an immediate off actuator is provided for turning off the pump during the post-advance period. This is useful, for example, if a leak of hydraulic fluid occurs during operation of the pump assembly, so it becomes desirable to turn the pump off immediately.

In a preferred form, actuation of the immediate off actuator admits compressed air to a second pilot port of the first pressure actuated air valve for shifting the first pressure actuated air valve so as to turn off the air motor. Thereby, this feature can be provided using air controls at a low cost. In one form, a flow restriction can be provided for timing relief of the second pilot port so that the pump does not restart if the immediate off actuator is deactuated before the end of the post-advance period.

In an especially preferred form, the second pilot port flow restriction is not provided, and instead a pilot pressure operated, spring return on/off (two way, two position) valve vents the second pilot port when the advance actuator is actuated. Thus, pressure is held on the second pilot port even after the immediate off actuator is released, until the advance actuator is actuated.

In another useful aspect, a pump assembly of the invention preferably includes a pair of hydraulic connectors for connecting to two hydraulic lines in communication with a hydraulic torque wrench. This is required for operating a double acting hydraulic torque wrench, which is where the invention provides the greatest advantages. However, the invention also provides advantages in operating a single acting wrench, and a pump assembly having two hydraulic connections can be used to operate such a wrench simply by plugging the connector which would otherwise be connected to the rod side port of a double acting wrench.

In another useful aspect, whether the invention is applied to operating a single acting or a double acting hydraulic wrench, it is preferred that the controls continue operation of the pump if the advance actuator is reactuated before the post-advance period expires. Thereby, the pump can be operated continuously if only brief pauses occur between deactuating and reactuating the advance actuator, as occur when tightening a fastener with multiple serial advances or when moving the wrench from one fastener to another. This, therefore, avoids restarting the pump, and the disadvantages associated therewith, such as increased wear of the components of the pump assembly and wrench, and major variations in the hydraulic pressure supplied by the pump assembly.

In this aspect, it is also preferred that each deactuation of the advance actuator start a new post-advance period, even if the deactuation follows an actuation which occurred during a post-advance period. This way, each post-advance period is of substantially the same duration (assuming no interruption by an actuation of the advance actuator), for consistent operation of the pump assembly.

DETAILED DESCRIPTION OF THE PREFERRED EMBODIMENTS

Figure 1:
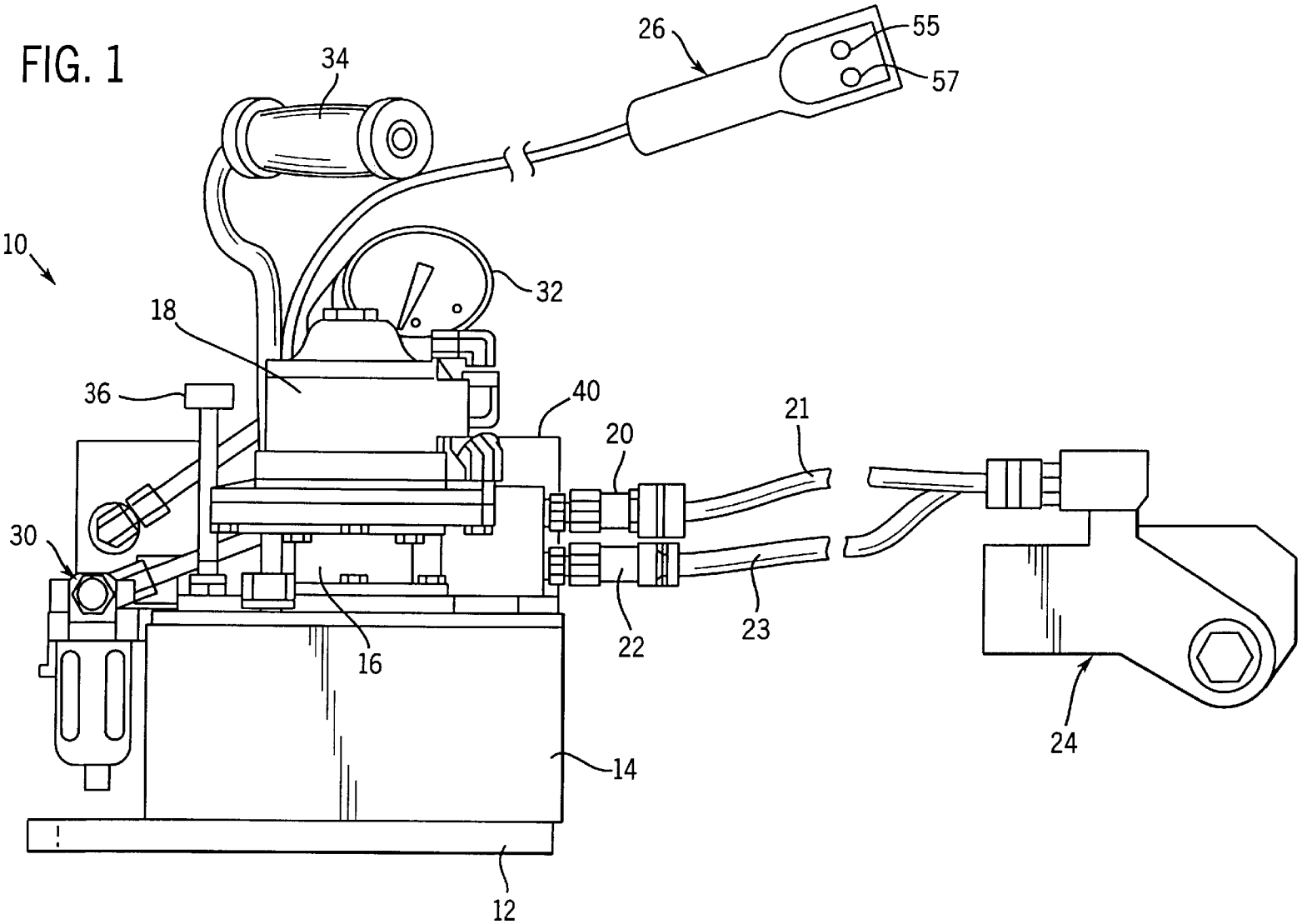
FIG. 1 is a side view of a torque wrench pump assembly incorporating the invention, shown together with a torque wrench.

Referring to FIG. 1, a pump assembly 10 of the invention has a base 12 on which is mounted a reservoir 14 of hydraulic fluid, hydraulic pump 16, an air motor 18 for driving the hydraulic pump 16, hydraulic connectors 20 and 22 for making a hydraulic connection between the pump assembly 10 and hydraulic lines 21 and 23 which are connected to torque wrench 24. The assembly 10 also includes a pendant assembly 26 for controlling the assembly 10 and an air inlet assembly 30 for connecting the assembly 10 to a source of compressed air. The assembly 10 also includes a hydraulic pressure gauge 32, a handle 34 and an adjustment dial 36 for an externally adjustable relief valve 114, described further below.

Figure 2:
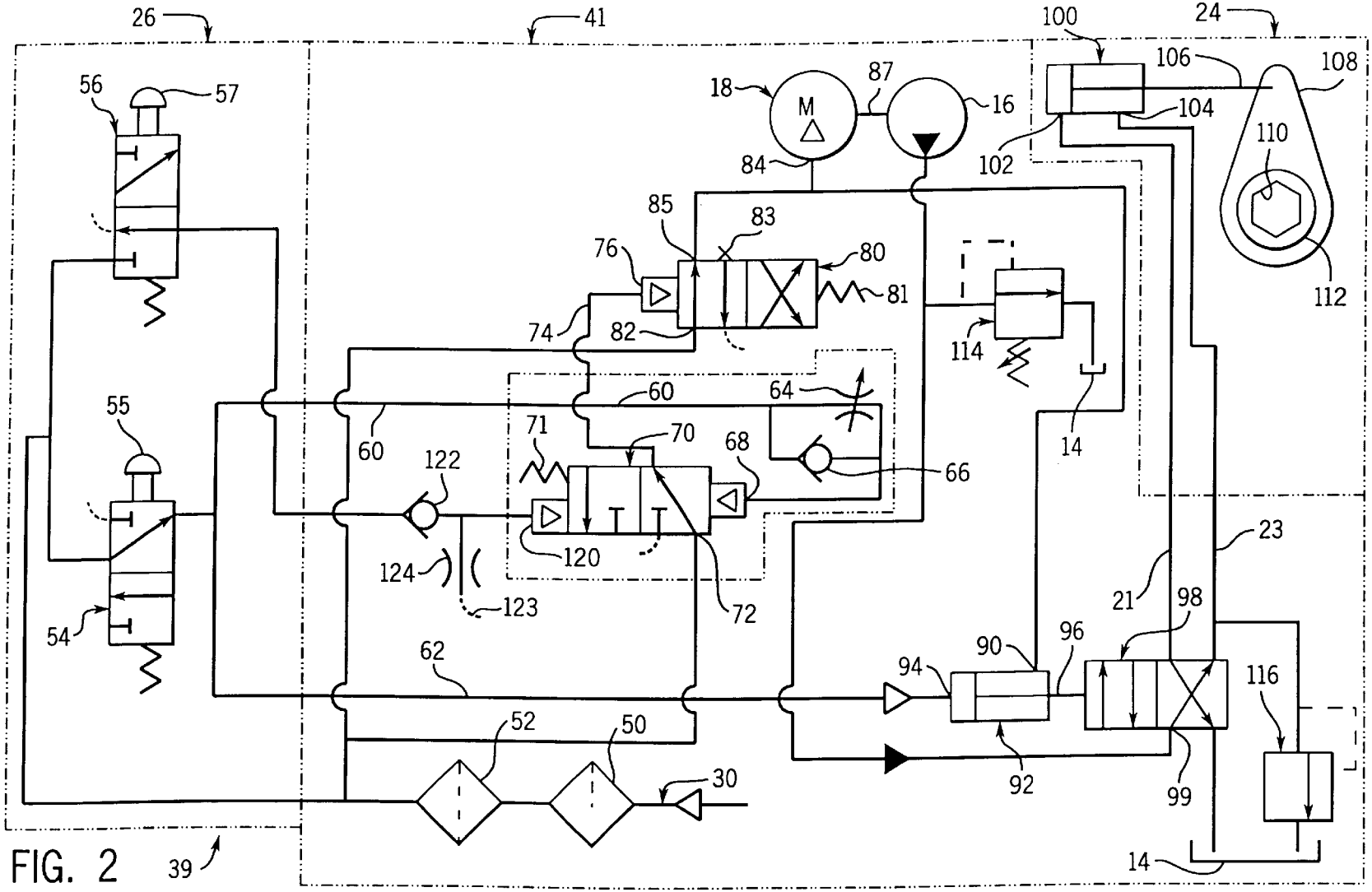
FIG. 2 is a schematic view of a hydro-pneumatic circuit for the pump assembly and wrench of FIG. 1.

The assembly 10 has a control logic housing 40 which houses many of the components of the hydro-pneumatic circuit 39 schematically depicted in FIG. 2. Portions of the circuit 39 which are in the pendant assembly 26 are identified within the dashed-lined box labeled 26, the portions of the circuit in the housing 40 or otherwise supported on the base 12 of the pump assembly 10 are indicated within the dashed-lined box identified as 41, and a schematic depiction of the torque wrench 24 is identified by box 24.

As shown in FIG. 2, the air supply connection 30 includes, as is typical, a lubricator 50 and a filter 52. Supply connection 30 provides communication of compressed air to two actuators which are housed in the pendant assembly 26. One of these actuators is the advance actuator 54 and the other is the immediate off actuator 56. In the pendant assembly 26, both of these actuators 54 and 56 are spring biased manual push-button type actuators, having respective buttons 55 and 57. It is noted that FIG. 2 is drawn with the actuator 54 in the actuated or depressed position, with certain other components as described below also in their actuated positions.

Actuator 54 provides for the communication of compressed air to two branches of the control circuit 39. These two branches are a first air line 60 and a first cylinder control line 62. The first air line 60 is in series with an air circuit which includes a flow restriction 64 in parallel with a one-way check valve 66. As illustrated in FIG. 2, the flow restriction 64 is manually adjustable, although a fixed restriction which is nonadjustable could be provided.

Check valve 66 is one-way so as to bypass flow around the restriction 64 in the direction from the actuator 54 to first pilot port 68 of a first pressure actuated air valve 70. Supply port 72 of valve 70 is in communication with the supply connection 30 so that when in the actuated position illustrated in FIG. 2, valve 70 provides compressed air to a second air line 74 which is in communication with pilot port 76 of second pressure actuated air valve 80. Valve 80, which is drawn in FIG. 2 as if pilot port 76 were pressurized, has its supply port 82 in communication with the supply connection 30 so that when in the position illustrated in FIG. 2 it provides compressed air to inlet 84 of air motor 18. When deactuated, port 82 is blocked, as indicated by the "X" 83 at the top of valve 80. Air motor 18 in the preferred embodiment is a rotary type vane air motor, for example, such as the model 4AM-NRV-50C available from Gast Mfg. Corp. of Benton Harbor, Mich. Of course, many other types of air motors could be used, and the invention is not limited to a rotary air motor but could be applied to a linear air motor as well.

The air motor 18 is mechanically coupled, as is well-known and indicated by line 87, to drive hydraulic pump 16, which if the air motor 18 has a rotary output would have a rotary input. However, as stated above, the pump 16 could also be a linear type of pump. Any type of hydraulic pump could be used to practice the invention, one such pump being the Atlas™ pump which is commercially available from Enerpac, a Division of Applied Power, Inc., Butler, Wis.

The outlet 85 of valve 80 also provides compressed air to the rod side port 90 of air cylinder 92. Piston side port 94 of cylinder 92 is in communication with the first cylinder control line 62, as illustrated. The piston rod 96 of cylinder 92 is mechanically coupled so as to shift a four-way two position hydraulic valve 98 between the retract position, which is illustrated in FIG. 2, and an advance position in which the valve 98 is shifted rightwardly from the position illustrated in FIG. 2.

It is noted that with equal pressures applied to the ports 94 and 90 of the cylinder 92, the valve 98 will be shifted into the advance position (the position not shown in FIG. 2) since the effective area of the piston in the cylinder 92 is larger on the side of the port 94 than it is on the side of the port 90, due to the area of the rod 96 on the side of the inlet 90.

The torque wrench 24 is hydraulically modeled by a double acting cylinder 100 having respective piston side and rod side ports 102 and 104 with its piston rod 106 mechanically coupled to lever 108 which is coupled to fastener drive socket 110 by a ratchet mechanism identified by circle 112, as is well-known in the art. Thus, torque wrench 24 only drives the socket 110 when the cylinder 100 is advanced, and lever 108 ratchets backwardly relative to socket 110 when the piston rod 106 is retracted.

Hydraulic pressure relief valves 114 and 116 are also preferably provided in the hydraulic supply and exhaust lines as illustrated so as to relieve any excessive hydraulic pressures which may be developed.

The first pressure actuated air valve 70 also has a second pilot port 120 which is provided with compressed air when actuator 56 is actuated, via one-way check valve 122. Between check valve 122 and pilot port 120, a restriction 124 which is vented to atmosphere (represented by a curved dashed line 123) is provided to relatively slowly bleed off air pressure from pilot 120 after actuator 56 is released.

The operation of the circuit 39 is as follows. With a source of compressed air connected to the pump assembly 10, when actuator 54 is depressed, as shown in FIG. 2, air is admitted to both of lines 60 and 62 so that via line 62 cylinder 92 advances so as to shift valve 98 rightwardly. This puts valve 98 into its advance position, so as to cause rod 106 to advance from cylinder 100, thereby advancing socket 110, when hydraulic fluid is supplied to port 102 of cylinder 100.

Compressed air from line 60 for the most part bypasses restriction 64 through one-way check valve 66 to immediately pressurize first pilot 68, which shifts valve 70 into the position illustrated in FIG. 2. This causes compressed air to flow from inlet 72 to the pilot port 76 of second valve 80, which shifts the valve 80 into the position shown in FIG. 2. In this position of the valve 80, pressurized air from the supply 30 is admitted to the inlet 84 of the air motor 18, which powers the air motor 18 to cause it to rotate, thereby rotating the hydraulic pump 16 to supply hydraulic pressure to inlet 99 of valve 98. Since with pressure supplied to inlet 94 of cylinder 92, the valve 98 is shifted into its advance position, hydraulic pressure from inlet 99 is directed to inlet 102 of cylinder 100, which causes the cylinder 100 to advance, valve 98 connecting port 104 of cylinder 100 with the reservoir 14.

When the wrench 24 reaches its stroke limit, the operator of the pendent assembly 26 releases the actuator 54, thereby causing the cylinder 100 to retract. This happens when actuator 54 is released because compressed air from lines 60 and 62 is relieved to atmosphere when actuator 54 is released. When atmosphere is connected to lines 60 and 62, valve 70 shifts rightwardly from the position shown in FIG. 2, but only after pressure from first pilot 68 bleeds off through restriction 64, this interval being referred to herein as a post-advance period. Restriction 64 is preferably sized or adjusted so that the post-advance period is about 15 seconds long.

During the post-advance period, cylinder 92 shifts leftwardly so as to place valve 98 into the position illustrated in FIG. 2, which is the retract position. In this position, valve 98 connects hydraulic supply port 99 to rod side port 104 and piston side port 102 is connected to the reservoir 14. This causes cylinder 100 to retract, ratcheting lever 108 backwardly over the socket 110, so as to be ready for the next advance stroke of the torque wrench 24.

During the post-advance period, the air motor 18 and pump 16 continue to operate. However, when pressure at port 68 is bled off through restriction 64, first valve 70 shifts rightwardly under the bias of spring 71, which vents pilot port 76 to atmosphere via second air line 74. Venting port 76 to atmosphere shifts valve 80 leftwardly under the bias of spring 81, which blocks port 82 and connects port 85 with atmosphere. Connecting port 85 with atmosphere vents the motor inlet 84, which causes the motor 18 to cease operating, which also causes the pump 16 to stop. Rod side inlet 90 of cylinder 92 is also vented to atmosphere when valve 80 is shifted leftwardly.

Thus, the pump assembly 10 continues operating for a period of time after the actuator 54 is deactuated so as to cause torque wrench 24 to retract, thereby making it ready for the next advance called for by the operator. If the next advance is called for by the operator (by pressing button 55), operation of the pump assembly 10 will continue without interruption. It will only stop after the actuator 54 is deactuated and the post-advance period expires without reactuation of the actuator 54. At that time, the motor 18 and pump 16 cease operation so as not to needlessly waste energy and cause heating of the hydraulic fluid.

Circumstances may arise such that during the post-advance period in which the actuator 54 is deactuated but the pump 16 is continuing in operation, it is desired to immediately cause the pump 16 to cease operation. That is the purpose of providing the actuator 56. When it is desired to turn the pump 16 off immediately, with actuator 54 deactuated so that it is in the up or deactuated position under the bias of its spring, the immediate off actuator 56 is actuated so as to admit pneumatic pressure to the second pilot port 120 via check valve 122. This causes valve 70 to shift rightwardly, even if there is residual pressure in the first pilot 68 since the pressure at second pilot 120 is greater than the pressure at pilot 68. Restriction 124 is sized to insure this to be the case.

Shifting valve 70 rightwardly causes operation of the motor 18 and pump 16 to cease immediately. as described above. Restriction 124 is provided so that pilot 120 stays pressurized for at least as long that as the first pilot 68 stays pressurized, so that if the actuator 56 is released during the post-advance period that the pilot 68 remains pressurized, the residual pressure in the pilot 120 will maintain the valve 70 in the rightward position in which port 76 is vented to atmospheric pressure.

As an alternative to the restriction 124, a two way, two position pilot operated spring return on/off valve 130 may be provided in communication with the second pilot port 120, downstream of the check valve 122. Valve 130 has a pilot port 132 in communication with lines 60 and 62 (and the output of advance actuator 54) so that when the advance actuator is actuated, valve 130 is shifted rightwardly from the position shown in FIG. 3, to vent port 120 to atmospheric pressure, so that a positive pressure at port 120 does not interfere with shifting valve 70 leftwardly by pressurizing port 68. When valve 54 is released, valve 130 is in the position illustrated in FIG. 3, with port 132 vented. In this position, port 120 is blocked so actuating valve 56 pressurizes port 120. and port 120 stays pressurized even after valve 56 is released (until normal leakage over a relatively long duration depletes it). Thus, even if valve 56 is released while there is a substantial pressure at port 68 valve 70 stays in its rightward position, in which port 76 is vented.

Figure 3:
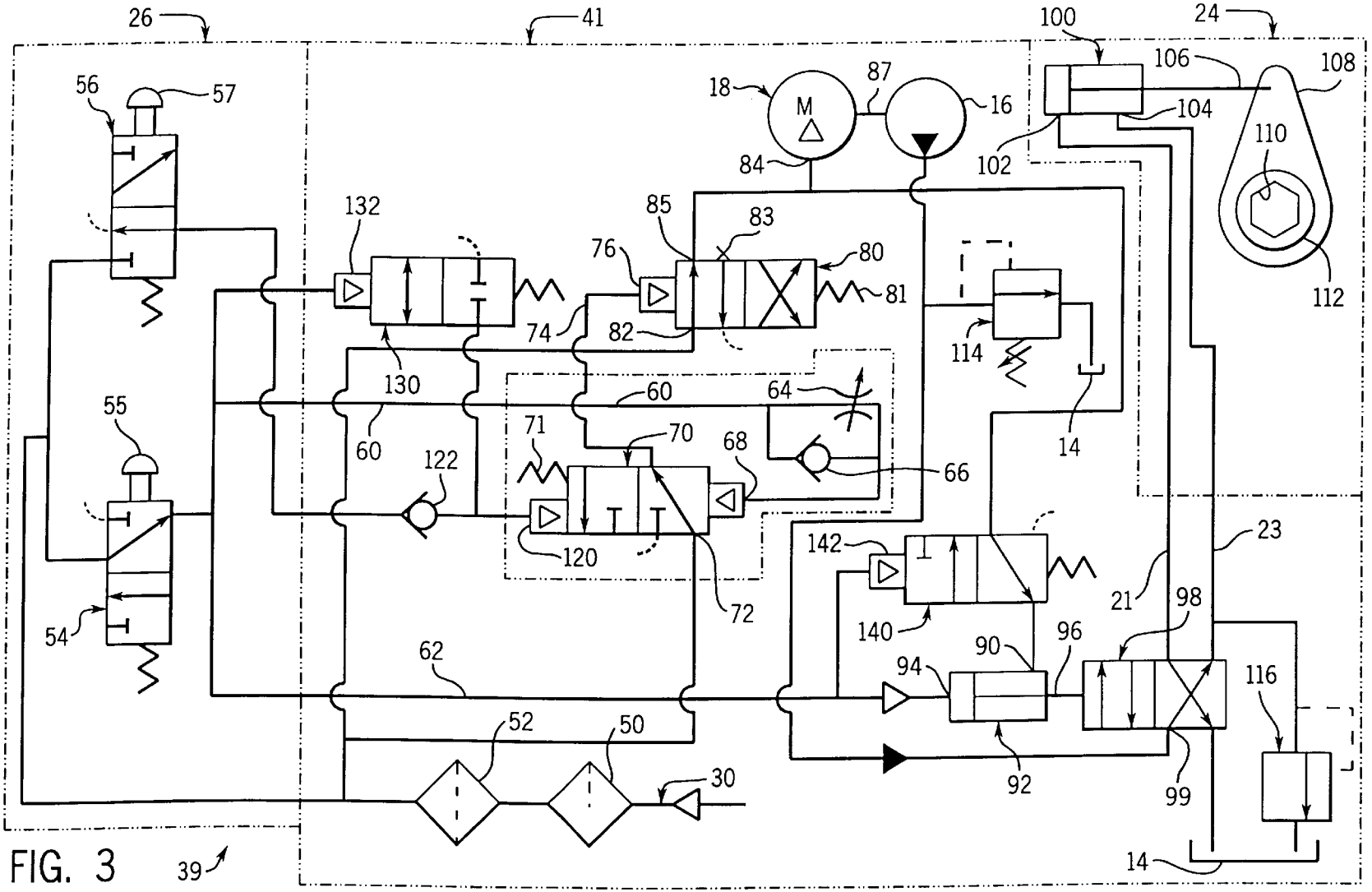
FIG. 3 is a view like FIG. 2 of a second embodiment of a hydro-pneumatic circuit for the pump assembly and wrench of FIG. 1.

The only other difference between the circuit of FIG. 3 and the circuit of FIG. 2 is that in FIG. 3 a three way, two position pilot operated spring return valve 140 is added to selectively vent the rod side port 90. In the position shown in FIG. 3, port 90 is communicated with port 85. This is the position of valve 140 which prevails when valve 54 is deactuated. When advance valve 54 is actuated, pilot port 142, which is connected to line 62, is pressurized which shifts valve 140 leftwardly. This vents port 90 so as not to resist rightward motion of rod 96 under the influence of pressure at bore side port 94. When valve 54 is deactuated, valve 140 assumes the position shown in FIG. 3 so as to retract rods 96 and 106 while valve 80 remains in the position shown in FIG. 3.

A preferred embodiment of the invention has been described in considerable detail. Many modifications and variations of the preferred embodiment described will be apparent to those skilled in the art. For example, the pumping unit 10 could be used to operate a single acting (i.e., spring return) hydraulic wrench, merely by plugging connector 22. If the circuit 39 is specially adapted to power only a single acting wrench, the port of valve 98 which is connected to hydraulic line 23 could be plugged, and connector 22, line 23 and relief valve 116 could be deleted. Although a post-advance period of operation would not be necessary to provide the retraction force for a single acting wrench since a spring in such a wrench provides this force, the post-advance period may be useful to avoid restarting the pump during short periods when the wrench is moved from one fastener to the next or between advances of the fastener by the wrench, instead of using a pump that turns off immediately after the advance actuator is deactuated. If the advance actuator 54 is reactuated before the post-advance period expires, the air motor 18 will continue to drive the pump 16 until the advance actuator 54 is deactuated and a new post-advance period expires, absent reactuation of the advance actuator 54.

Therefore, the invention should not be limited to the embodiments described, but should be defined by the claims which follow.

I claim:

1. A compressed air-powered hydraulic torque wrench apparatus of the type having an air motor which drives a hydraulic pump for supplying hydraulic fluid under pressure to a hydraulic torque wrench and having controls including an advance actuator which when actuated supplies a flow of hydraulic fluid under pressure to said wrench to cause said wrench to advance in rotation, the improvement wherein said controls continue operation of said air motor after said advance actuator is deactuated and said wrench has terminated advancement in rotation to drive said hydraulic pump until a post-advance period of operation has expired, an immediate off actuator is provided for turning off said pump during said post-advance period and said controls prevent said pump from restarting if said immediate off actuator is deactuated before expiration of said post-advance period.

2. The improvement of claim 1, wherein said advance actuator actuates an air valve which when actuated pressurizes through a first air line a first pilot port of a first pressure actuated air valve, the actuation of which causes said air motor to be powered.

3. The improvement of claim 2, wherein said first air line includes a flow restriction and a one-way check valve which bypasses said restriction in the flow direction toward said pilot port of said first pressure actuated valve.

4. The improvement of claim 2, wherein a second air line communicates air pressure from said first pressure actuated air valve to a pilot port of a second pressure actuated air valve, said second pressure actuated air valve shifting when said pilot port is actuated to admit pressurized air to an inlet of said air motor.

5. The improvement of claim 1, wherein said pump assembly includes a pair of hydraulic connectors for connecting to two hydraulic lines in communication with a hydraulic torque wrench.

6. The improvement of claim 1, wherein actuation of said immediate off actuator admits compressed air to a pilot port of a pressure actuated air valve for shifting said pressure actuated air valve so as to turn off said air motor.

7. The improvement of claim 6, wherein said controls include a flow restriction which provides gradual relief of pressure from said pilot port so that said pump does not restart before expiration of said post-advance period.

8. The improvement of claim 6, wherein said controls include a pilot pressure operated valve which relieves pressure from said pilot port when said advance actuator is actuated.

9. The improvement of claim 1, wherein said controls continue operation of said pump if said advance actuator is reactuated before said post-advance period expires.

10. The improvement of claim 9, wherein said controls begin a new post-advance period each time said advance actuator is deactuated.

* * * * *